US007247365B2

(12) United States Patent
Sato

(10) Patent No.: US 7,247,365 B2
(45) Date of Patent: Jul. 24, 2007

(54) THERMALLY TRANSFERABLE PROTECTIVE SHEET

(75) Inventor: Yasuhiro Sato, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 11/236,542

(22) Filed: Sep. 28, 2005

(65) Prior Publication Data

US 2006/0068174 A1 Mar. 30, 2006

(30) Foreign Application Priority Data

Sep. 30, 2004 (JP) ..... 2004-287502

(51) Int. Cl.
*B41M 5/40* (2006.01)

(52) U.S. Cl. ..... 428/212; 428/195.1; 428/219; 428/352; 428/480

(58) Field of Classification Search ..... 503/227
See application file for complete search history.

(56) References Cited

U.S. PATENT DOCUMENTS 5,006,502 A * 4/1991 Fujimura et al. ..... 503/227

FOREIGN PATENT DOCUMENTS

JP 2000-71626 A 3/2000

* cited by examiner

*Primary Examiner*—Bruce H. Hess
(74) *Attorney, Agent, or Firm*—Birch, Stewart, Kolasch & Birch, LLP

(57) ABSTRACT

To provide a thermally transferable protective sheet which, upon forming a protective layer on a image-receiving member, can provide the protective layer without causing rainbow unevenness.

A thermally transferable protective sheet which has a protective layer that comprises a peeling layer and an adhesive layer on at least one portion of one face of a substrate sheet, and is thermally transferable, and the peeling layer and the adhesive layer are respectively constituted by resins that have different upper and lower values of refractive indexes, with a refractive index of 1.5 serving as its border.

3 Claims, 1 Drawing Sheet

THERMALLY TRANSFERABLE PROTECTIVE SHEET

BACKGROUND OF THE INVENTION

1. Field of the Invention

This invention relates to a thermally transferable protective sheet.

2. Description of the Related Art

Conventionally, images such as tone images and mono-tone images including characters and symbols have been formed on a substrate by using a thermal transfer system. With respect to the thermal transfer system, a heat-sensitive sublimation transfer system and a heat-sensitive melt transfer system have been widely used.

Of these system, in the heat-sensitive sublimation transfer system, a thermal transfer sheet, formed by placing a dye layer made by melting or dispersing a sublimable dye serving as a colorant in a binder resin on a substrate, is used, and with this thermal transfer sheet being superposed on an image receiving sheet, energy in accordance with image information is applied to a heating device such as a thermal head so that the sublimable dye contained in the dye layer on the thermal transfer film is transferred to the image-receiving sheet; thus, an image is formed thereon. This heat-sensitive sublimation transfer system makes it possible to control the amount of dye transfer on a dot basis in response to the quantity of energy to be applied to the thermal transfer sheet; therefore, this system has the advantages of forming a superior tone image and of easily forming characters, symbols and the like.

With respect to the tone image and mono-tone image formed by the heat-sensitive sublimation transfer system, since the transferred dye is present on the surface of the transferred subject, and since the dye is not a pigment but a substance having a comparatively low molecular weight, those images are inferior in light resistance, particularly, in light resistance to ultraviolet rays. For this reason, various attempts have been made so as to improve the light resistant property. For example, a technique has been proposed in which a protective layer containing an ultraviolet-ray absorbing agent is transferred onto a transferred subject (image-receiving sheet) on which an image is formed so as to improve the light resistant property of the image (for example, Patent Document 1).

It has been conventionally known that the protective layer of this type is generally applied and formed with an amount of coat in the range from 0.1 $g/m^2$ to 5 $g/m^2$ (dried state). As long as the functions of the protective layer are maintained, the protective layer is preferably made as thin as possible from the viewpoint of saving resources.

However, as the layer thickness of the protective layer is made as thin as possible, rainbow unevenness due to visible light reflection comes to appear on the image surface caused by even a slight difference in layer thickness. The rainbow unevenness refers to interference fringes that occur between the image surface and the protective layer. The rainbow unevenness is remarkably observed, in particular, when a protective layer is formed on a black solid image, and since the rainbow unevenness makes it difficult to view an image printed on the transferred subject, the occurrence of this phenomenon needs to be prevented.

[Patent Document 1] Japanese Patent Application Laid-Open No. 2000-71626

BRIEF SUMMARY OF THE INVENTION

The present invention has been made to solve the above-mentioned problems, and its objective is to provide a thermally transferable protective sheet which can provide a protective layer that is free from rainbow unevenness, even when the protective layer is formed on a image-receiving member.

The present invention relates to a thermally transferable protective sheet which has a protective layer that comprises a peeling layer and an adhesive layer, formed on at least one portion of one face of a substrate sheet, and is thermally transferable, and the peeling layer and the adhesive layer are respectively constituted by resins that have different refractive indexes.

REFERENCE NUMERALS

Figure 1:
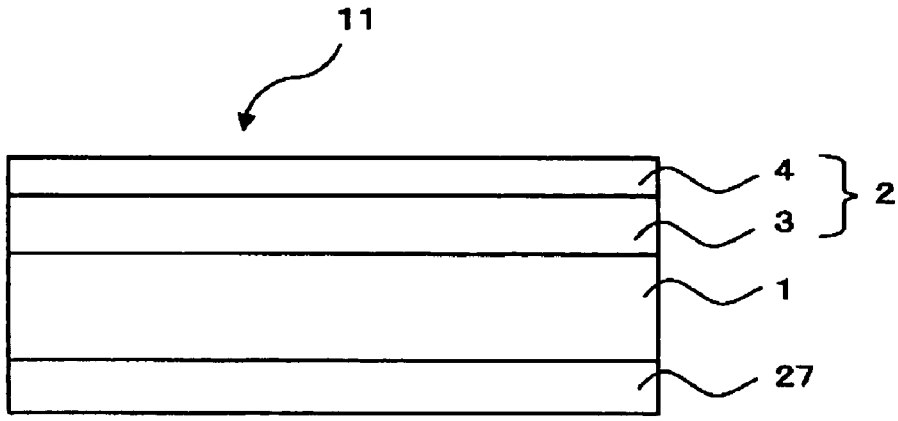
FIG. 1 is a schematic sectional view that shows one embodiment of a thermally transferable protective sheet of the present invention.

11, 21 Thermal transfer-type film
1, 22 Substrate sheet
2 Thermal transferable protective layer
3 Peeling layer
4 Adhesive layer
27 Back layer

DETAILED DESCRIPTION OF THE INVENTION

The present invention is achieved by a thermally transferable protective sheet which has a protective layer that comprises a peeling layer and an adhesive layer, formed on at least one portion of one face of a substrate sheet, and is thermally transferable, and the peeling layer and the adhesive layer are respectively constituted by resins that have different refractive indexes.

In the present invention, the "refractive index" indicates a value measured by using the method of JIS K 7142.

The peeling layer and the adhesive layer are constituted by resins having respectively different refractive indexes, and one of the layers is formed by using a resin having a refractive index of less than 1.5 while the other layer is formed by using the resin having a refractive index of 1.5 or more, with a refractive index of 1.5 serving as its border. In order to achieve the objective of the present invention, in addition to forming the peeling layer and the adhesive layer by using resins having respectively different refractive indexes, it is also important to properly adjust the amount of coat of the peeling layer. From these viewpoints, thermally transferable protective sheets having the following three modes are prepared.

The present invention provides a thermally transferable protective sheet which has a protective layer that comprises a peeling layer and an adhesive layer on at least one portion of one face of a substrate sheet, and is thermally transferrable, and the peeling layer is constituted by a resin having a refractive index of 1.5 or more and the adhesive layer is constituted by a resin having a refractive index of less than 1.5, and in this structure, the peeling layer is applied and formed with an amount of coat in the range from 1.0 to 3.0 g/m$^2$ after dried and the adhesive layer is applied and formed with an amount of coat in the range from 0.5 to 2.0 g/m$^2$ after dried (Mode 1 of the invention).

The present invention provides a thermally transferable protective sheet which has a protective layer that comprises a peeling layer and an adhesive layer on at least one portion of one face of a substrate sheet, and is thermally transferable and the peeling layer is constituted by a resin having a refractive index of less than 1.5, and the adhesive layer is constituted by a resin having a refractive index in the range from 1.5 or more to less than 1.55, and in this structure, the peeling layer is applied and formed with an amount of coat of 2.0 g/m$^2$ or more after dried, and the adhesive layer is applied and formed with an amount of coat in the range from 0.5 to 2.0 g/m$^2$ after dried (Mode 2 of the invention).

The present invention provides a thermally transferable protective sheet which has a protective layer that comprising a peeling layer and an adhesive layer on at least one portion of one face of a substrate sheet, and is thermally transferable, and the peeling layer is constituted by a resin having a refractive index of less than 1.5, and the adhesive layer is constituted by a resin having a refractive index of 1.55 or more, and in this strucure, the peeling layer is applied and formed with an amount of coat of 2.5 g/m$^2$ or more after dried, and the adhesive layer is applied and formed with an amount of coat in the range from 0.5 to 2.0 g/m$^2$ after dried (Mode 3 of the invention).

FIG. 1 shows a schematic sectional view of one example of the thermally transferable protective sheet of the present invention. In this Figure, in the thermally transferable protective sheet 1, a protective layer 2, constituted by a peeling layer 3 and an adhesive layer 4, is formed on one of faces of a substrate sheet 1.

The following description will discuss the present invention successively from Mode 1.

With respect to the substrate sheet 1, not particularly limited, the same substrate sheet as those widely used in this field may be used. Specific examples of the substrate sheet include: polyesters having high heat resistance, such as polyethylene terephthalate, polyethylene naphthalate, polybutylene terephthalate, polyphenylene sulfide, polyether ketone and polyether sulfone; and plastic films, such as polypropylene, polycarbonate, cellulose acetate, derivatives of polyethylene, polyvinyl chloride, polyvinylidene chloride, polystyrene, polyamide, polyimide, polymethyl pentene and ionomer, and a laminated member and the like of these. The above-mentioned plastic film may be used as a drawn film, or may be used as an undrawn film. The thickness of the substrate sheet, which is properly selected by taking the strength, heat resistance and the like into consideration, is normally set in the range from 1 to 100 μm.

In Mode 1 of the invention, the protective layer 2 to be formed on the substrate sheet is constituted by a peeling layer constituted by a resin having a refractive index of 1.5 or more and an adhesive layer constituted by a resin having a refractive index of less than 1.5, and the peeling layer is applied and formed with an amount of coat in the range from 1.0 to 3.0 g/m$^2$ after having been dried and the adhesive layer is applied and formed with an amount of coat in the range from 0.5 to 2.0 g/m$^2$ after having been dried.

With respect to the resin having a refractive index in the range from 1.5 or more to less than 1.55, examples thereof include polyacrylonitrile, polyethylene, Nylon 6, polyester, and vinyl chloride-vinyl acetate copolymer. With respect to the resin having a refractive index of 1.55 or more, examples thereof include polyester, polyamide-imide. styrene-acrylonitrile copolymers, polystyrene and polyethylene terephthalate.

With respect to polyester resin, the ones having a polar group such as a sulfonic acid group, an amino group, a carboxylic acid group, a phosphonic acid group at the end or side chain of the polyester resin show a high refractive index compared to homopolymer of polyester resin as polarizability showing electrical distortion is high. Concretely, a refractive index of such a poyester resin having a polar group is in the range of 1.52–1.59. In the present invention, the "refractive index" indicates a value measured according to the method of JIS K 7142. Such a polyester resin as has a polar group has a glass transition temperature of approximately 60 to 100° C. If the glass transition temperature is less than 60° C., thermally transferred-images are liable to bleed when printed articles are preserved under high temperature conditions. If the glass transition temperature is more than 120° C., foil-separating property deteriorates in a thermal transfer process.

Polyamide-imide resin has preferably a molecular weight in the range between 5000 and 30000, and the ones having a glass transition temperature of approximately 200–350° C. are preferably used. Such a polyamide resin is available in the market as (VYLOMAX® (trade name) HR11NN, HR12N2, HR13NX, HR14ET, HR15ET, HR16NN (made by Toyobo Co., Ltd.). If the glass transition temperature is too high, solubility to a solvent becomes poor. If the glass transition temperature is too low, durability such as resistance to plasticizer becomes poor resulting in difficulty in coating. The peeling layer containing a polyamide-imide resin is transferred to a printed article as a protective layer and achromatism and transparency are required. Therefore, in particular (VYLOMAX® (trade name) HR14ET, HR15ET are preferably used.

With respect to the resin having a refractive index of less than 1.5, examples thereof include polytetrafluoroethylene, vinylidene fluoride, polyvinyl acetate, acrylic resin, and (meth)acrylate resin (which means both acrylate resin and methacrylate resin).

It is possible to use resins having a different refractive index. In such a case, a value obtained from Σ (refractive index×weight ratio) is adjusted within the above range of the refractive index.

In Mode 1 of the invention, the peeling layer is formed with an amount of coat in the range from 1.0 to 3.0 g/m$^2$ after having been dried. When the amount of coat of the peeling layer is less than 1.0 g/m$^2$, the resulting sheet fails to solve the problem of rainbow unevenness. When the total amount of coat of the peeling layer and the adhesive layer becomes too large, the resulting protective layer tends to have degradation in releasing property during the transferring process to cause a failure in transferring a protective layer with a predetermined size onto the image-receiving member; therefore, these layers are preferably made as thin as possible.

In Mode 1 of the invention, the adhesive layer is applied and formed with an amount of coat in the range from 0.5 to 2.0 g m$^2$ after having been dried.

The peeling layer and adhesive layer that form the protective layer may contain the following additives on demand: inorganic fine particles such as silica filler, alumina filler and titanium oxide, organic fine particles such as polyethylene wax and acrylic filler, an antioxidant such as a phenol-based, phosphate-based or sulfur-based antioxidant, a photo-stabilizer such as hindered amine, a fluorescent whitener and an ultraviolet-ray absorbing agent.

The peeling layer and adhesive layer forming the protective layer are formed through the following processes: ink, prepared by dissolving or dispersing resin and other additives, if necessary, in a solvent such as water and an organic solvent, is applied by using a normal coating method such as a gravure printing method, a screen printing method and a reverse roll coating method using a gravure plate, and the resulting layers are dried.

The following description will discuss Mode 2 of the present invention. In Mode 2 of the present invention, the peeling layer is constituted by a resin having a refractive index of less than 1.5, and the adhesive layer is constituted by a resin having a refractive index in the range from 1.5 or more to less than 1.55, and in these layers, the peeling layer is applied and formed with an amount of coat of 2.0 $g/m^2$ or more after having been dried, and the adhesive layer is applied and formed with an amount of coat in the range from 0.5 to 2.0 $g/m^2$ after having been dried.

With respect to the substrate sheet, the resin having a refractive index in the range from 1.5 or more to less than 1.55 and the resin having a refractive index of less than 1.5, the same resins as those used in Mode 1 may be used.

With respect to the adhesive layer of Mode 2 of the invention, the same layer as that of Mode 1 of the invention may be used except that the refractive index of the constituent resin is different.

The peeling layer in accordance with Mode 2 of the invention is applied and formed with an amount of coat of 2.0 $g/m^2$ or more, preferably 2.4 $g/m^2$ or more. When the amount of coat is too low, it is not possible to solve the problem of rainbow unevenness. When the total amount of coat of the peeling layer and the adhesive layer becomes too large, the resulting protective layer tends to have degradation in releasing property during the transferring process to cause a failure in transferring a protective layer with a predetermined size onto the image-receiving member; therefore, these layers are preferably made as thin as possible.

The peeling layer and the adhesive layer may contain additives in the same manner as Mode 1 of the invention, and upon forming the respective layers, the same methods as those of Mode 1 may be used.

The following description will discuss Mode 3 of the invention. In Mode 3 of the invention, the peeling layer is constituted by a resin having a refractive index of less than 1.5, and the adhesive layer is constituted by a resin having a refractive index of 1.55 or more, and in these layers, the peeling layer is applied and formed with an amount of coat of 2.5 $g/m^2$ or more after having been dried, and the adhesive layer is applied and formed with an amount of coat in the range from 0.5 to 2.0 $g/m^2$ after having been dried.

In the substrate sheet, with respect to the resin having a refractive index in the range of 1.55 or more, the same resin as that of Mode 1 of the invention may be used.

With respect to the adhesive layer of Mode 3 of the invention, the same layer as that of Mode 1 of the invention may be used except that the refractive index of the constituent resin is different.

The peeling layer in accordance with Mode 3 of the present invention is applied and formed with an amount of coat of 2.5 $g/m^2$ or more, preferably 2.9 $g/m^2$ or more. When the amount of coat is too low, it is not possible to solve the problem of rainbow unevenness. When the total amount of coat of the peeling layer and the adhesive layer becomes too large, the resulting protective layer tends to have degradation in releasing property during the transferring process to cause a failure in transferring a protective layer with a predetermined size onto the image-receiving member; therefore, these layers are preferably made as thin as possible.

The peeling layer and the adhesive layer may contain additives in the same manner as Mode 1 of the invention, and upon forming the respective layers, the same methods as those of Mode 1 of the invention may be used.

In the present invention, a release layer may be formed between the substrate sheet and the protective layer. In the case when the separating property between the substrate film and the protective layer is not appropriate, the release layer is formed, if necessary, so as to adjust the bonding property between the substrate film and the protective layer and also to carry out the peeling process of the protective layer desirably. When the releasing layer is prepared, the releasing layer is formed in such a manner that, after the protective layer has been separated from the protective layer through a transferring process, the releasing layer itself is allowed to remain on the substrate film side.

The release layer is constituted by, for example, various waxes such as silicone wax or silicone oil, and various resins such as silicone resin, fluorine resin, (meth)acrylic resin (which is used as a term including both of acrylic resins and methacrylic resins), silicone-modified (meth)acrylic resin, water soluble resin, cellulose derivative resin, urethane-based resin, acetic acid-based vinyl resin, acrylic vinyl ether-based resin and maleic anhydride resin, and mixtures thereof.

The release layer may contain additives such as a curing agent and an ultraviolet ray absorbing agent, and the release layer is formed through processes in which: a coating solution containing at least one material selected from the group consisting of the above-mentioned waxes and resins, with additives contained therein, if necessary, is applied to a substrate film by using a conventionally known coating method such as a wire-coating method and the resulting coated layer is cured, if necessary, and dried. The thickness of the release layer is normally set in the range from 0.5 to 5.0 μm.

In the present invention, a back layer may be formed on the other face of the substrate sheet. The back layer is formed so as to prevent heat seal between a heating device such as a thermal head and the substrate sheet 1 and provide a smooth traveling operation. With respect to the resin to be used for this back layer, examples thereof include: cellulose-based resins, such as ethyl cellulose, hydroxy cellulose, hydroxypropyl cellulose, methyl cellulose, cellulose acetate, cellulose butyrate, nitrocellulose; vinyl-based resins, such as polyvinyl alcohol, polyvinyl acetate, polyvinyl butyral, polyvinyl acetal and polyvinyl pyrrolidone; acrylic resins, such as polymethyl methacrylate, polyethyl acrylate, polyacrylamide and acrylonitrile-styrene copolymer; polyamide resin; polyvinyl toluene resin; coumarone indene resin; polyester resin; polyurethane resin; and a simple substance or a mixture of natural or synthetic resins, such as silicone-modified or fluorine-modified urethane. In order to further improve the heat resistance of the back layer, among the above-mentioned resins, a resin having a reactive group such as a hydroxide-group-(for example, butyral resin, acetal resin and the like) is used while polyisocyanate or the like is used in combination as a crosslinking agent; thus, a crosslinked resin layer is preferably used as the back layer.

In order to impart a sliding property with the thermal head, a solid-state or liquid-state release agent or a lubricant may be added to the back layer so as to provide a heat-resistant lubricating property. With respect to the release agent or lubricant, examples thereof include: various waxes such as polyethylene wax and paraffin wax; various surfactants, such as higher fatty alcohol, organopolysiloxane, anionic surfactants, cationic surfactants, amphoteric surfactants, nonionic surfactants and fluorine-based surfactants; organic carboxylic acid and derivatives thereof, fluorine-based resins, silicone-based resins, fine particles of inorganic compounds, such as talc and silica. The amount of lubricant to be contained in the back layer is set in the range from 5 to 50% by weight, more preferably from 10 to 30% by weight, in the back layer.

The back layer is formed through processes in which: an ink, prepared by dissolving or dispersing the resin and the other additives in a solvent such as water and an organic solvent, is applied to a substrate sheet by using a normal coating method such as a gravure printing method, a screen printing method and a reverse coating method using a gravure plate, and the resulting layer is dried. The thickness of the back layer is normally set in the range from 0.1 to 10 μm, more preferably from 0.5 to 5 μm.

The thermally transferable protective sheet of the present invention is not intended to be limited by the above-mentioned mode, and is desirably formed in accordance with the intended purpose as a sheet such as a composite thermally transferable protective sheet with a thermally transferring protective layer and a heat sublimabile color material layer or a heat meltable color material layer. In the case of the composite thermally transferable protective sheet, as long as the image-receiving member has a receiving layer for dyes, an image-forming process through a thermal transfer system and a transferring process of the protective layer to the image-receiving member are simultaneously carried out.

With respect to another example, a thermally transferable protective sheet in which a thermal transferring protective layer and at least one color material layer selected from the group consisting of a heat sublimabile color material layer and a heat meltable color material layer are formed on one of surfaces of a substrate sheet in a face-sequential manner is exemplified.

Figure 2:
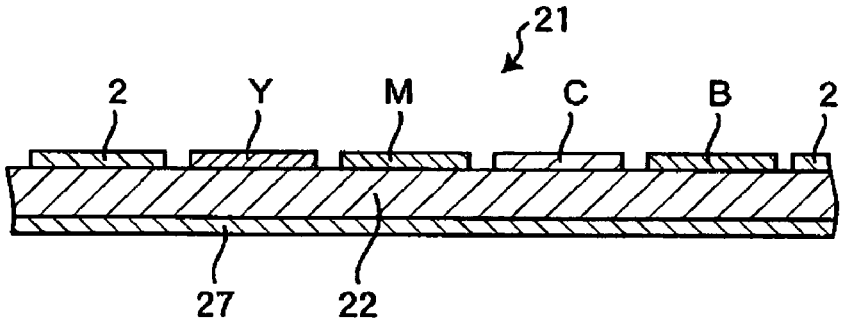
FIG. 2 is a schematic sectional view that shows another embodiment of a thermally transferable protective sheet of the present invention.

FIG. 2 is a schematic sectional view that shows another example of the thermally transferable protective sheet of the present invention. In FIG. 2, a thermally transferable protective sheet 21 of the present invention is constituted by a heat sublimable color material layer Y, a heat sublimable color material layer M, a heat sublimable color material layer C, a heat sublimable color material layer B and a thermal transferring protective layer that are formed on one of the faces of a substrate sheet 22 in a face-sequential manner, with a back layer 27 being formed on the other face of the substrate sheet 22. The thermal transferring protective layer is constituted by the protective layer 2 that has been explained above.

The heat sublimable color material layers Y, M, C and B, shown in FIG. 2, may be replaced by heat meltable color material layers Y, M, C and B, or a mixed structure of these layers may be used.

With respect to the image-receiving member on which the protective layer is transferred by using the thermally transferable protective sheet of the present invention, not particularly limited, any material may be used.

Examples of the image-receiving member include sheets formed by any substrate, such as plain paper, wood free paper, tracing paper and a plastic film. The image-receiving member may have any one of forms including a card, a post card, a passport, letter paper, report paper, a notebook and a catalogue.

Specific examples of the image-receiving member of the present invention include: premium tickets, such as share certificates, bonds, certificates, passbooks, train tickets, bicycle or horse race tickets, stamps, postal stamps, theater tickets, entrance tickets and other tickets; various cards, such as cash cards, credit cards, prepaid cards, members cards, greeting cards, post cards, name cards, driver's licenses, IC cards and optical cards; cases such as cartons and containers; bags; forms, envelopes, tags, OHP sheets, slide films, bookmarks, calendars, posters, pamphlets, menus, passports, POP articles, coasters, displays, name plates, keyboards, cosmetics, ornaments, such as wristwatches and lighters; stationary such as writing materials and report paper; building materials, panels, emblems, keys, cloths, clothing, footwear, apparatuses such as radios, televisions, electronic calculators and OA devices, various sample catalogues, albums, outputs from computer graphics, medical image outputs, and the like.

The image on the image-receiving member may be formed through any one of the systems, such as an electrophotographic system, an ink-jet recording system and a thermal transfer recording system.

Upon using the thermally transferable protective sheet of the present invention, any one of conventionally known application methods of the thermally transferable protective sheet, as it is, may be used. For example, the protective layer surface of the thermally transferable protective sheet of the present invention is superposed on the image-receiving member so that the thermal transferring resin layer is thermally transferred onto the image-receiving member.

(Effects of the Invention)

By using the thermally transferable protective sheet of the present invention, it becomes possible to transfer a protective layer free from rainbow unevenness on a image-receiving member.

The following description will discuss the present invention by means of examples. In the following Examples, "parts" and "%" respectively refer to "parts by mass" and "% by mass", unless otherwise indicated.

EXAMPLES

Test Examples 1 to 43

Formation of Thermally Transferable Protective Sheet (Formation of Slip Layer)

A heat-resistant slip layer coating solution, which had the following composition, was preliminarily applied onto one surface of a substrate (thickness: 4.5 μm, polyethylene terephthalate film (brand name 4WF597, made by Toray Co., Ltd.)) by using a gravure coating method, and dried thereon with an amount of coat of 1.0 g/m$^2$ in the dried state so that a heat-resistant slip layer was formed. In the same manner, a coating solution for a release layer, which had the following composition, was applied onto the surface opposite to the heat-resistant slip layer by using a gravure coating method, and dried thereon with an amount of coat of 1.0 g/m$^2$ in the dried state.

| (Heat-resistant slip layer composition solution) | |
|---|---|
| Polyvinyl butyral resin (S-LEC BX-1, made by Sekisui Chemical Co., Ltd.) | 13.6 parts |
| Polyisocyanate curing agent (Takenate D218, made by Mitsui Takeda Co., Ltd.) | 0.6 parts |

-continued

| (Heat-resistant slip layer composition solution) | |
|---|---|
| Phosphate (Plysurf A208S, made by Dai-ichi Kogyo Seiyaku Co., Ltd.) | 0.8 parts |
| Methylethylketone | 42.5 parts |
| Toluene | 42.5 parts |

A coating solution for a release layer, which had the following composition, was applied to the face opposite to the printed face of the heat-resistant slip layer by using a gravure coating method with an amount of coat of 1.0 g/m$^2$ in the dried state, and the coated layer was dried for one minute at 110° C. in an oven.

| (Formation of release layer) Coating solution for release layer | |
|---|---|
| Silicone-modified acrylic resin (Celltop 226, made by Daicel Chemical Industries, Ltd.) | 16 parts |
| Silicone-modified acrylic resin (Celltop 227, made by Daicel Chemical Industries, Ltd.) | 8 parts |
| Vinyl chloride-vinyl acetate copolymer resin (Solbine A, made by Nissin Chemical Industry Co., Ltd.) | 2.4 parts |
| Curing catalyst (Celltop CAT-A, made by Daicel Chemical Industries, Ltd.) | 4.5 parts |
| Ultraviolet-ray absorbing agent (Uvitex OB, made by Ciba Specialty Chemicals Co., Ltd.) | 0.05 parts |
| Toluene | 9.8 parts |
| Metylethylketone | 9.8 parts |

(Formation of Protective Layer)

By using a coating solution 1, 2, 3, 4 or 5 having the following composition, a release layer and an adhesive layer were formed on the release layer by using each of the combinations of coating solutions and each of amounts of coat shown in the following Table 1 and Table 2. The coating process was carried out by using a gravure coating method, and the coating solution was dried for one minute at 110° C. so that the respective layers were formed.

| <Coating solution 1 for protective layer> | |
|---|---|
| Vinyl chloride-vinyl acetate copolymer resin (Solbine CNL, made by Nissin Chemical Industry Co., Ltd.) (Refractive index: 1.52) | 4.5 parts |
| Ultraviolet-ray absorbing agent (UVA 635L, made by BASF Japan Ltd.) | 15 parts |
| Acrylic resin solution (Thermolac LP-45M, Soken Chemical & Engineering Co., Ltd, solid component: 40%) (Refractive index: 1.49) | 4.69 parts |
| Polyethylene wax (particle size: 6 μm) | 0.07 parts |
| Toluene | 10.37 parts |
| Methylethylketone | 10.37 parts |

| <Coating solution 2 for protective layer> | |
|---|---|
| Polymethylmethacrylate resin (DIANAL ® BR-87, made by Mitsubishi Rayon Co., Ltd.) (Refractive index: 1.49) | 10 parts |
| Polyester resin (Vylon 200, made by Toyobo Co., Ltd.) (Refractive index: 1.56) | 0.01 part |

-continued

| <Coating solution 2 for protective layer> | |
|---|---|
| Ultraviolet-ray absorbing agent (Uvitex OB, made by Ciba Specialty Chemicals Co., Ltd.) | 0.02 part |
| Toluene | 10 parts |
| MEK | 10 parts |

| <Coating solution 3 for protective layer > | |
|---|---|
| Polyester resin (Vylon 200, made by Toyobo Co., Ltd.) (Refractive index: 1.56) | 19 parts |
| Silica (Sylysia 310P, made by Fuji Silysia Chemical Ltd.) | 0.5 parts |
| Polymer-type ultraviolet-ray absorbing agent (PUVA 50M-40TM, made by Ohtsuka Chemical Co., Ltd.) | 12 parts |
| Ultraviolet-ray absorbing agent (TINUVIN900, made by Ciba Specialty Chemicals Co., Ltd.) | 2.4 parts |
| Toluene | 19 parts |
| Methylethylketone | 19 parts |

| <Coating solution 4 for protective layer > | |
|---|---|
| Polyamide-imide resin solution (VYLOMAX ® HR15ET; made by Toyobo Co., Ltd.) (average molecular weight: 10,000, glass transition temperature: 260° C., solid content: 20%, refractive index: 1.55) | 100 parts |

| <Coating solution 5 for protective layer > | |
|---|---|
| Polyester resin having a sodium sulfonate group (Vylon 885, made by Toyobo Co., Ltd.) (Refractive index: 1.55) | 20 parts |
| Methylethylketone | 40 parts |
| Toluene | 40 parts |

(Evaluation)

Each of thermally transferable protective sheets obtained in the above-mentioned respective test examples was cut and pasted onto a thermally transferable protective sheet portion of a thermal transferring sheet exclusively used for a MEGAPIXEL-II (made by Altech Co., Ltd.) and by using each of these in combination with thermal transferring image-receiving paper exclusively used for the MEGAPIXEL-II (made by Altech Co., Ltd.), a protective layer was formed on a solid black image printed by the sublimation printer MEGAPIXEL-II (made by Altech Co., Ltd.). The appearance of the image-receiving member on which the protective layer had been formed was visually evaluated, based upon the following criteria, and ranked with respect to rainbow unevenness. Tables 1 and 2 collectively shows the results.

3: No rainbow unevenness was visually observed.

2: Slight rainbow unevenness was visually confirmed.

1: Rainbow unevenness was visually confirmed over the entire surface.

TABLE 1

| Test example | Peeling layer | resin | Refractive index | Amount of coat ($g/m^2$) | bonding layer | resin | Refractive index | Amount of coat ($g/m^2$) | rainbow unevenness (Sensitive evaluation) |
|---|---|---|---|---|---|---|---|---|---|
| 1 | coating | vinyl chloride- | 1.51 | 0.4 | coating | acrylic resin | 1.49 | 0.8 | 1 |
| 2 | solution 1 | vinyl acetate/ | | 1.1 | solution 2 | | | | 3 |
| 3 | | acrylic resin | | 1.6 | | | | | 3 |
| 4 | | | | 2.3 | | | | | 3 |
| 5 | | | | 2.9 | | | | | 3 |
| 6 | coating | Polyester | 1.56 | 0.4 | coating | acrylic resin | 1.49 | 0.8 | 1 |
| 7 | solution 3 | | | 1.0 | solution 2 | | | | 3 |
| 8 | | | | 1.6 | | | | | 3 |
| 9 | | | | 2.3 | | | | | 3 |
| 10 | | | | 2.6 | | | | | 3 |
| 11 | coating | acrylic resin | 1.49 | 0.7 | coating | vinyl | 1.51 | 0.8 | 1 |
| 12 | solution 2 | | | 1.1 | solution 1 | chloride- | | | 2 |
| 13 | | | | 1.5 | | vinyl | | | 2 |
| 14 | | | | 2.4 | | acetate/ | | | 3 |
| 15 | | | | 2.9 | | acrylic resin | | | 3 |
| 16 | coating | acrylic resin | 1.49 | 0.7 | coating | polyester | 1.56 | 0.8 | 1 |
| 17 | solution 2 | | | 1.1 | solution 3 | | | | 1 |
| 18 | | | | 1.5 | | | | | 2 |
| 19 | | | | 2.4 | | | | | 2 |
| 20 | | | | 2.9 | | | | | 3 |
| 21 | coating solution 2 | acrylic resin | 1.49 | 1.5 | coating solution 3 | polyester | 1.56 | 1.5 | 2 |
| 22 | coating | polyamide-imide | 1.55 | 0.4 | coating | acrylic resin | 1.49 | 0.8 | 1 |
| 23 | solution 4 | | | 1.0 | solution 2 | | | | 3 |
| 24 | | | | 1.6 | | | | | 3 |
| 25 | | | | 2.3 | | | | | 3 |
| 26 | | | | 2.6 | | | | | 3 |

TABLE 2

| Test example | Peeling layer | resin | Refractive index | Amount of coat ($g/m^2$) | bonding layer | resin | Refractive index | Amount of coat ($g/m^2$) | rainbow unevenness (Sensitive evaluation) |
|---|---|---|---|---|---|---|---|---|---|
| 27 | coating | acrylic resin | 1.49 | 0.7 | coating | polyamide- | 1.55 | 0.8 | 1 |
| 28 | solution 2 | | | 1.1 | solution 4 | imide | | | 1 |
| 29 | | | | 1.5 | | | | | 2 |
| 30 | | | | 2.4 | | | | | 2 |
| 31 | | | | 2.9 | | | | | 3 |
| 32 | coating solution 2 | acrylic resin | 1.49 | 1.5 | coating solution 4 | polyamide-imide | 1.55 | 1.5 | 2 |
| 33 | coating | polyester | 1.55 | 0.4 | coating | acrylic resin | 1.49 | 0.8 | 1 |
| 34 | solution 5 | | | 1.0 | solution 2 | | | | 3 |
| 35 | | | | 1.6 | | | | | 3 |
| 36 | | | | 2.3 | | | | | 3 |
| 37 | | | | 2.6 | | | | | 3 |
| 38 | coating | acrylic resin | 1.49 | 0.7 | coating | polyester | 1.55 | 0.8 | 1 |
| 39 | solution 2 | | | 1.1 | solution 5 | | | | 1 |
| 40 | | | | 1.5 | | | | | 2 |
| 41 | | | | 2.4 | | | | | 2 |
| 42 | | | | 2.9 | | | | | 3 |
| 43 | coating solution 2 | acrylic resin | 1.49 | 1.5 | coating solution 5 | polyester | 1.55 | 1.5 | 2 |

(Measurements on Refractive Index)

The refractive indexes of ink resins used in the respective test examples were measured by using the method of JIS K 7142.

What is claimed is:

1. A thermally transferable protective sheet, comprising:

a protective layer comprising a peeling layer and an adhesive layer, wherein the protective layer is formed on at least one portion of one face of a substrate sheet, and wherein the protective layer is thermally transferable, and wherein the peeling layer is constituted by a resin selected from the group consisting of polyacrylonitrile, polyethylene, Nylon 6, polyester and vinyl chloride-vinyl acetate copolymer, and wherein the peeling layer resin has a refractive index of 1.5 or more to less than 1.55, and wherein the adhesive layer is constituted by a resin selected from the group consisting of polytetrafluoroethylene, vinylidene fluoride, polyvinyl acetate, acrylic resin and (meth)acrylate resin, and wherein the adhesive layer resin has a refractive index of less than 1.5; and wherein the peeling layer is applied and formed with an amount of coat in the range from 1.0 to 3.0 $g/m^2$ after dried and the adhesive layer is applied and formed with an amount of coat in the range from 0.5 to 2.0 $g/m^2$ after dried.

2. A thermally transferable protective sheet, comprising:

a protective layer comprising a peeling layer and an adhesive layer, wherein the protective layer is formed on at least one portion of one face of a substrate sheet, and wherein the protective layer is thermally transferable, and wherein the peeling layer is constituted by a resin selected from the group consisting of polyester, polyamide-imide, styrene-acrylonitrile copolymers and polystyrene, and wherein the peeling layer resin has a refractive index of 1.55 or more, and wherein the adhesive layer is constituted by a resin selected from the group consisting of polytetrafluoroethylene, vinylidene fluoride, polyvinyl acetate, acrylic resin and (meth)acrylate resin, and wherein the adhesive layer resin has a refractive index of less than 1.5; and wherein the peeling layer is applied and formed with an amount of coat in the range from 1.0 to 3.0 $g/m^2$ after dried and the adhesive layer is applied and formed with an amount of coat in the range from 0.5 to 2.0 $g/m^2$ after dried.

3. The thermally transferable protective sheet according to claim 2, wherein the peeling layer is constituted by a polyethylene terephthalate resin.

* * * * *